US007806095B2

(12) United States Patent
Cook et al.

(10) Patent No.: US 7,806,095 B2
(45) Date of Patent: Oct. 5, 2010

(54) VEHICLE STARTING ASSIST SYSTEM

(75) Inventors: Alexander Cook, Dublin, OH (US); Wenzhe Lu, Dublin, OH (US); Alexander Isurin, Dublin, OH (US)

(73) Assignee: Vanner, Inc., Hilliard, OH (US)

( * ) Notice: Subject to any disclaimer, the term of this patent is extended or adjusted under 35 U.S.C. 154(b) by 0 days.

(21) Appl. No.: 12/201,818

(22) Filed: Aug. 29, 2008

(65) Prior Publication Data

US 2009/0056661 A1 Mar. 5, 2009

Related U.S. Application Data

(60) Provisional application No. 60/969,323, filed on Aug. 31, 2007.

(51) Int. Cl.
*F02N 11/08* (2006.01)

(52) U.S. Cl. ..... 123/179.3; 290/38 R

(58) Field of Classification Search ..... 123/179.3; 290/38 R, 40 C

See application file for complete search history.

(56) References Cited

U.S. PATENT DOCUMENTS 5,041,776 A * 8/1991 Shirata et al. ..... 322/29
5,146,095 A * 9/1992 Tsuchiya et al. ..... 290/38 R
5,155,373 A * 10/1992 Tsuchiya et al. ..... 290/38 R
5,155,374 A * 10/1992 Shirata et al. ..... 290/38 R
5,642,696 A * 7/1997 Matsui ..... 123/179.1
6,325,035 B1 * 12/2001 Codina et al. ..... 123/179.1
7,436,080 B2 * 10/2008 Hackl et al. ..... 290/40 C
7,610,891 B2 * 11/2009 Seufert et al. ..... 123/179.25
2002/0024322 A1 * 2/2002 Burke ..... 320/166
2004/0112320 A1 * 6/2004 Bolz et al. ..... 123/179.28
2005/0224035 A1 * 10/2005 Burke et al. ..... 123/179.3
2005/0247280 A1 * 11/2005 Asada et al. ..... 123/179.3
2005/0279544 A1 * 12/2005 Pott et al. ..... 180/65.2
2006/0098390 A1 * 5/2006 Ashtiani et al. ..... 361/502
2009/0050092 A1 * 2/2009 Handa et al. ..... 123/179.3
2010/0019737 A1 * 1/2010 Leboeuf ..... 320/167

* cited by examiner

*Primary Examiner*—Stephen K Cronin
*Assistant Examiner*—Anthony L Bacon
(74) *Attorney, Agent, or Firm*—Eley Law Firm Co.; James R. Eley; Michael A. Forhan

(57) ABSTRACT

An engine starting assist system. A battery is selectably coupled to an ultracapacitor with a contactor. In addition, a controller is configured to perform at least one of: monitor the condition of the battery, monitor the condition of the ultracapacitor, control the flow of energy between the battery and the ultracapacitor by selective actuation of the contactor, receive a start input control. The controller issues a start output control to a starter solenoid of the engine, such that energy stored in the ultracapacitor may be used to at least one of charge the battery and provide cranking current to a starter of the engine in conjunction with the battery.

20 Claims, 4 Drawing Sheets

VEHICLE STARTING ASSIST SYSTEM

This application claims priority to U.S. provisional patent application No. 60/969,323, filed Aug. 31, 2007, the contents of which are hereby incorporated by reference.

FIELD

The present invention relates generally to vehicle electrical systems, in particular to a system to assist with vehicle engine starting and to start a vehicle having a discharged engine cranking battery.

BACKGROUND

It is unfortunately a relatively common experience among many operators of motor vehicles that a well-maintained or even relatively new internal combustion engine cannot be started when the battery that supplies the power to the starter is discharged below a minimum power level needed to crank the engine. In many cases an external power source, such as a second battery, must be coupled to the discharged battery with jumper cables to provide auxiliary power to start the engine. However, such external power sources and/or cables may not be readily available. In addition, connecting jumper cables to a battery can be dangerous because the battery emits combustible gases, and a spark resulting from such a connection may ignite the gases. Furthermore, improper connection of the jumper cables between the auxiliary battery and the discharged battery can cause damage to the vehicle's electrical system.

Another common problem associated with motor vehicles is that the cranking battery used to start the internal combustion engine has reduced amp-hour capacity at low ambient temperatures due to the temperature sensitivity of the chemical reactions inherent in such batteries. This drawback, coupled with the typically greater cranking current required to overcome the increased internal friction of a cold engine, can result in a failure to start the engine, particularly if the battery has not been fully charged or suffers from reduced capacity due to battery aging.

Yet another concern is the high cranking current demanded of a battery during the starting cycle of an internal combustion engine. This high current demand can quickly and deeply discharge the battery, which adversely affects the capacity and life of the battery. There is a need for a way to utilize on-board supplementary power sources to provide auxiliary power to start the vehicle's engine and to charge the cranking battery when it is discharged.

SUMMARY

A starting system for an internal combustion engine according to an embodiment of the present invention includes a battery which supplies electrical energy to a starter motor through a starter control to start the engine. An alternator driven by the engine charges the battery. The starter control utilizes a controller and an ultracapacitor to assist the battery in providing energy to the starter to crank the engine for starting. The starter control may also transfer to the battery energy stored by the ultracapacitor, thereby charging the battery.

An object of the present invention is an engine starting assist system. A battery is selectably coupled to an ultracapacitor with a contactor. In addition, a controller is configured to perform at least one of: monitor the condition of the battery; monitor the condition of the ultracapacitor; control the flow of energy between the battery and the ultracapacitor by selective actuation of the contactor; and receive a start input control. The controller issues a start output control to a starter solenoid of the engine, such that energy stored in the ultracapacitor may be used to at least one of charge the battery and provide cranking current to a starter of the engine in conjunction with the battery.

Another object of the present invention is a method for controlling the starting of an engine. A battery is selectably connected to a starter of the engine. An ultracapacitor is provided, and at least one of the battery and the ultracapacitor are charged. The battery and the ultracapacitor are selectably coupled together such that energy stored in the ultracapacitor may be used to at least one of charge the battery and provide cranking current to a starter of the engine in conjunction with the battery.

BRIEF DESCRIPTION OF THE DRAWINGS

Further features of the present invention will become apparent to those skilled in the art to which the present invention relates from reading the following specification with reference to the accompanying drawings, in which.

DETAILED DESCRIPTION

Figure 1:
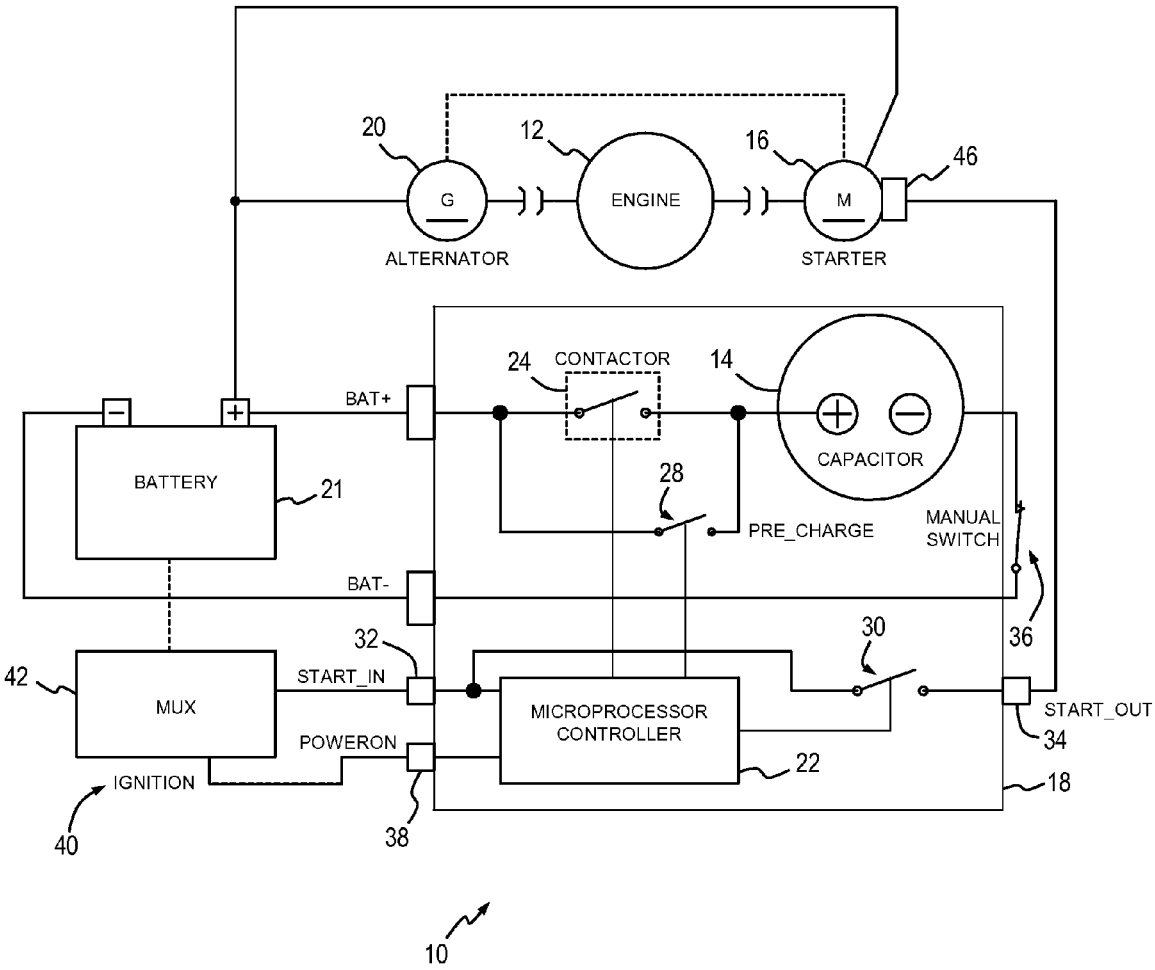
FIG. 1 is a block diagram of a vehicle starting assist system according to an embodiment of the present invention.

In the discussion that follows, like reference numerals are used to refer to like elements in the various figures.

With reference to FIG. 1, according to an embodiment of the present invention a starting system 10 for an internal combustion engine 12 comprises a capacitor 14 which supplies electrical energy to a starter motor 16 through a starter control 18 to start the engine. An alternator 20 that is mechanically driven by engine 12 generates electrical energy to charge a battery 21.

Starter control 18 includes a controller 22 that controls actuation of a contactor 24 that is coupled between a positive terminal of battery 21 and a positive terminal of capacitor 14. Controller 22 also selectably controls actuation of a precharge switch 28 that is connected in parallel with contactor 22 and a start switch 30 that is coupled between a START_IN input 32 and a START_OUT output 34 of starter control 18. A manual switch 36 is connected between a negative terminal of capacitor 14 and a negative terminal of battery 21.

Controller 22 may be implemented in any conventional form including, without limitation, computers, microcontrollers, central processing units (CPU), programmable controllers and logic devices, microprocessors, and ladder logic devices. Controller 22 may include one or more sets of predetermined algorithms and/or instructions (hereafter "computer program") to define the various operational aspects of the controller. The computer program may be stored in a memory portion of controller 22.

In one embodiment of the present invention capacitor 14 is a conventional "ultracapacitor." Ultracapacitors provide a large amount of capacitance in a very small form factor, thereby providing for storage of significant amounts of energy in a relatively small package. Ultracapacitors are sometimes referred to as "supercapacitors," "electrochemical capacitors" and "double layer capacitors." Ultracapacitors are notable for their ability to store more energy per unit weight and volume than conventional capacitors. They are also able to deliver the stored energy at higher rates than is possible with other electrochemical devices, such as batteries.

Although switches 28, 30 are shown schematically in FIG. 1 as single pole single throw (SPST) switches, it will be appreciated that these switches may be implemented using electronic components including, without limitation, transistors. Furthermore, the on-off duty cycle of the switches 28, 30 may be controlled in a predetermined manner by controller 22. For example, pre-charge switch 28 may be duty cycle controlled using pulse width modulation to control or limit the amount of current flowing therethrough, thereby acting as a charge control for energy flowing from battery 21 to capacitor 14 and vice versa.

Figure 2:
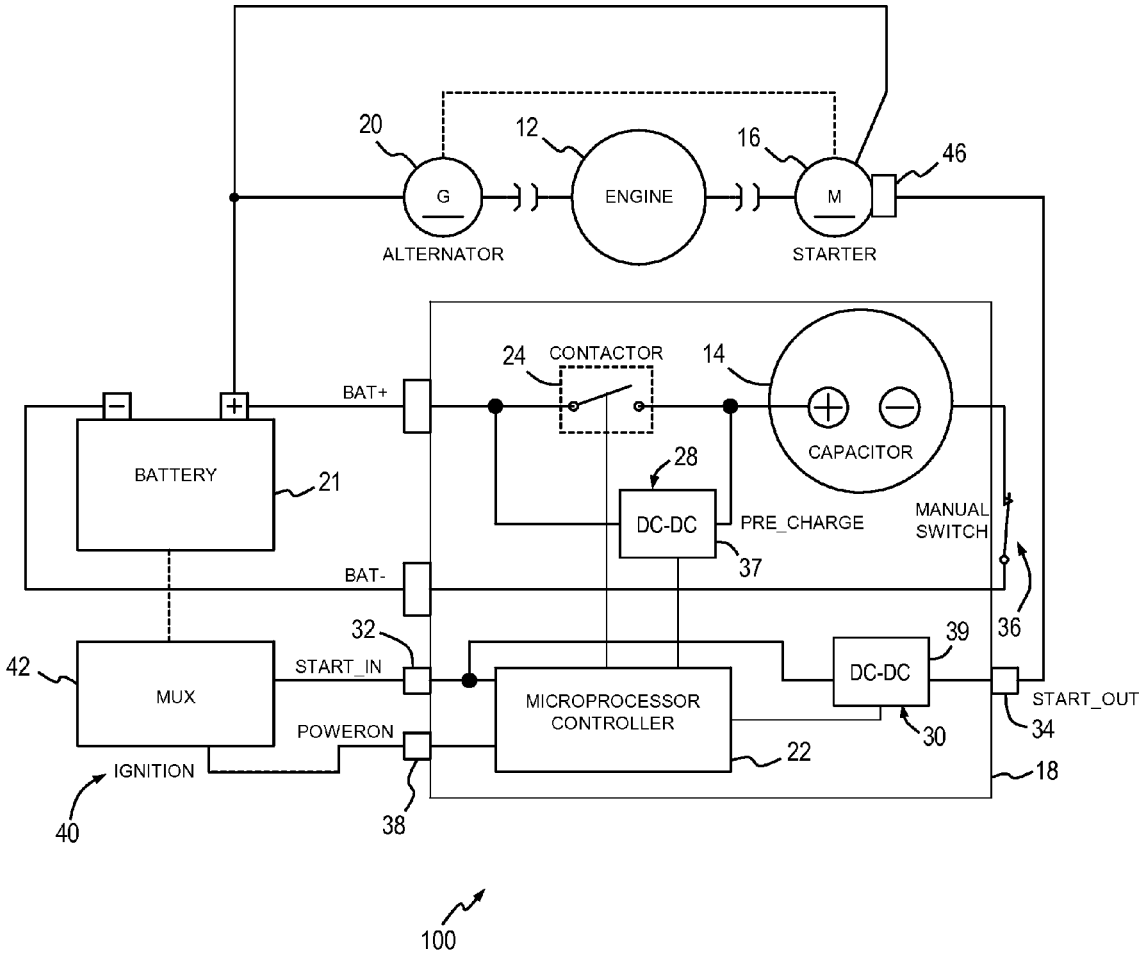
FIG. 2 is a block diagram of a vehicle starting assist system according to an alternate embodiment of the present invention.

In some embodiments of the present invention either or both of the SPST on-off type switches 28, 30 of FIG. 1 may be implemented in the form of selectably activated unidirectional or bidirectional DC-DC converters. For example, with reference to FIG. 2, in a starting assist system 100 switch 28 may be configured as a step-up DC-DC converter 37 to selectably, under the control of controller 22, convert a relatively low battery 21 voltage to a higher DC voltage for charging capacitor 14. In this way DC-DC converter 37 functions as both on-off switch 28 and as a voltage converter. Likewise, on-off switch 30 of FIG. 1 may be similarly implemented as a DC-DC converter 39 selectably controlled by controller 22, as shown in FIG. 2.

Electrical power for operating controller 22, contactor 24 and switches 28, 30 may be supplied by one or more of battery 21, capacitor 14, and control signals provided to START_IN input 32 and POWERON input 38. These inputs and control signals are detailed further, below.

With reference again to FIG. 1, during one operational mode of system 10, starter control 18 is activated by supplying an activation control signal to POWERON input 38 of the starter control, the activation control signal being received by controller 22. In one embodiment of the present invention the activation control signal is provided by an IGNITION output 40 of a conventional multiplexed vehicle control system 42, the activation control signal being either a selectively applied voltage (logic high active state) or selectively applied ground (logic low active state) input. Multiplexed vehicle control systems 42 utilize communications buses to reduce the number of wires required to link vehicle accessories with the appropriate accessory switch and to link displays and control systems with the appropriate sensors and transducers. In general terms, each accessory switch and each sensor are coupled via appropriate transmitters to a data bus line. Similarly, each accessory and each display or other receivers of sensor information such as, for example, control processors, are coupled via appropriate receivers to the same bus line.

Figure 3:
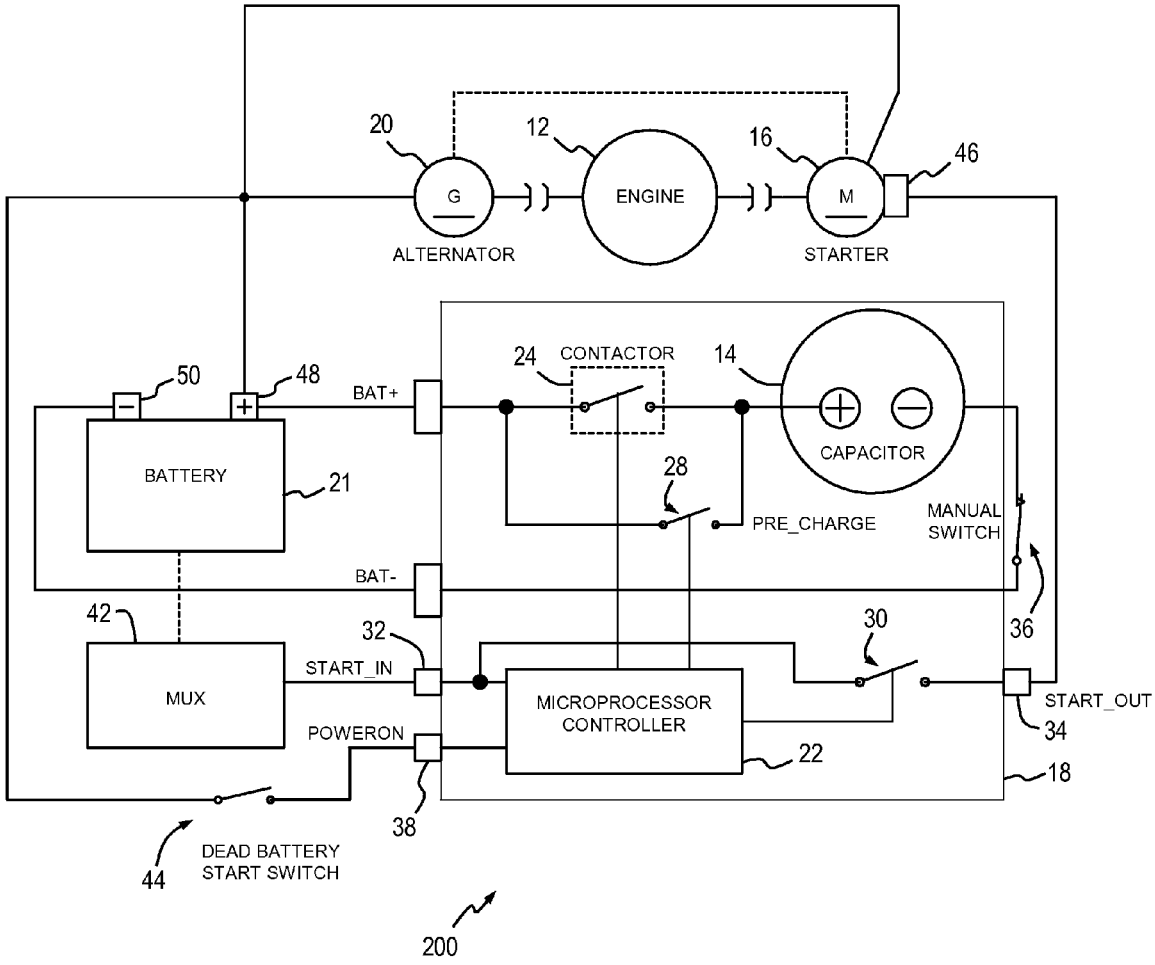
FIG. 3 is a block diagram of a vehicle starting assist system according to another alternate embodiment of the present invention.
Figure 4:
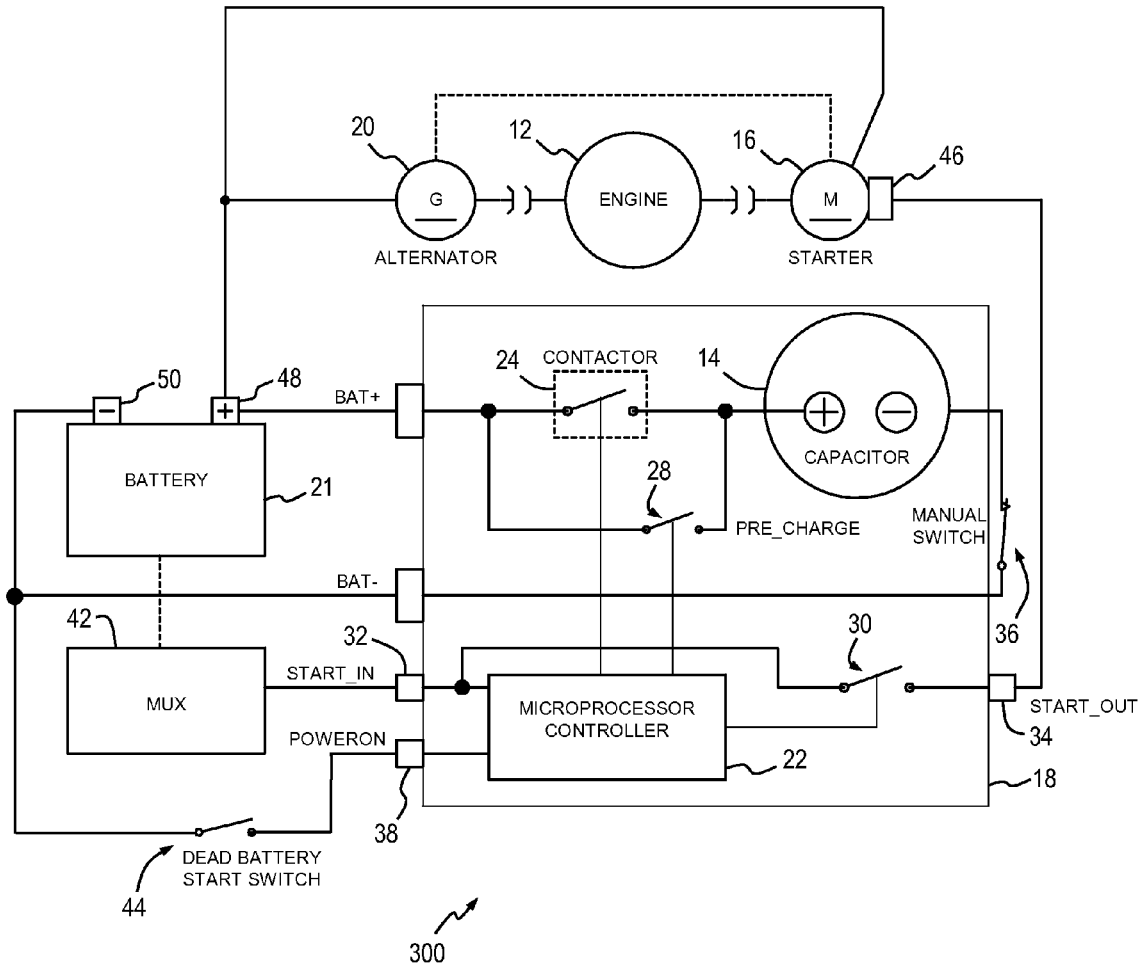
FIG. 4 is a block diagram of a vehicle starting assist system according to yet another alternate embodiment of the present invention.

Alternatively the POWERON activation control signal may be provided by a dead battery switch 44 as shown in FIGS. 3 and 4. Dead battery switch 44 may be connected to a positive terminal 48 of battery 21 in a starting system 200, as shown in FIG. 3. In this embodiment of the present invention POWERON input 38 is configured as a selectively applied voltage (logic high active state) connection. Dead battery switch 44 may alternatively be connected to a negative terminal 50 of battery 21 in a starting system 300, as shown in FIG. 4. In this embodiment of the present invention POWERON input 38 is configured as a selectively applied ground (logic low active state) connection.

With the POWERON input 38 in an active state, upon receiving an appropriate (i.e., active high or active low state) start control signal at START_IN input 32, controller 22 closes start switch 30 to supply a corresponding output start control signal at START_OUT output terminal 34, the output start command signal being communicated to a solenoid 46 configured to selectably couple energy from battery 21 to starter 16. Upon receiving the output start command signal solenoid 46 couples starter 16 to battery 21 to engage the starter, thereby starting engine 12. In this operational mode controller 22 checks the voltages of battery 21 and capacitor 14 using connection lines (not shown) coupled thereto and determines that battery 21 is sufficiently charged to start engine 12. Controller 22 may optionally actuate contactor 24 or switch 28 to charge capacitor 14, if desired.

In a second operational mode of system 10, if additional energy is needed to operate starter 16, an activation signal is provided to POWERON input terminal 38 by IGNITION output 40, thereby activating controller 22. Controller 22 checks the voltages of battery 21 and capacitor 14 using connection lines (not shown) coupled thereto. If controller 22, using predetermined criteria, determines that capacitor 14 requires charging, the controller actuates pre-charge switch 28 causing energy to flow from battery 21 to the capacitor therethrough. When controller 22 determines, using predetermined criteria, that capacitor 14 is sufficiently charged, a START_IN control signal provided to input 32 of starter control 18 and received by the controller causes the controller to actuate start switch 30, thereby engaging starter 16 in the manner previously described. Controller 22 also actuates contactor 24, thereby coupling capacitor 14 to battery 21 such that engine-cranking current is supplied to starter 16 by both the battery and the capacitor. A significant portion of the cranking current will be supplied by capacitor 14, as the capacitor has a relatively low internal impedance.

When engine 12 starts the engine will mechanically drive alternator 20, the electrical output of which charges both battery 21 and capacitor 14. Controller 22 monitors the charging process and de-actuates contactor 24 and/or switch 28 when capacitor 14 is charged. This prevents discharge of capacitor 14 when engine 12 is off but accessories (not shown) are connected to battery 21 and consuming energy therefrom.

In a third operational mode of system 10, when engine 12 is off and accessories are left coupled to battery 21, the battery may become discharged. In some cases the discharged battery 21 voltage may drop to a level that is too low to operate multiplexed vehicle control system 42, preventing the generation of an IGNITION output 40 control signal. In such cases POWERON terminal 38 of starter control 18 may alternately be connected to dead battery switch 44 to activate controller 22 in the manner previously described. In particular, it will be appreciated that, if a logic low active state connection is utilized for dead battery switch 44, a control (i.e. ground) signal may be provided to POWERON input 38 even if battery 21 is completely discharged. When controller 22 is activated the controller actuates contactor 24 causing charging current to flow from a charged capacitor 14 to battery 21. When the battery 21 is recharged to a predetermined minimum voltage level, multiplexed vehicle control system 42 will resume normal operation, thereby providing an IGNITION output 40 control signal and allowing an engine 12 starting cycle in the manner previously described.

Manual switch 36 may be used by an operator of system 10. When switch 36 is closed system 10 operates in the manner described above. When switch 36 is open capacitor 14 is disconnected from battery 21. Thus, manual switch 36 may be used as a safety device to disable system 10 for servicing or maintenance.

As can be appreciated from the foregoing discussion, engine starting system 10 supports engine 12 start assist during normal battery charge conditions, and provides an alternate energy source for starting the engine in the event of a dead battery. In the process of carrying out these functions system 10 pre-charges capacitor 14 via switch 28 before closing contactor 24 when capacitor voltage is low. This prevents a large inrush current from the battery to the capacitor.

Furthermore, a START_IN control signal provided to input 32 is ultimately originated by an operator desiring to start engine 12. System 10 evaluates the charge condition of battery 21 and capacitor 14 and generates a START_OUT output 34 control signal only after optimum energy control of the battery and capacitor, for their condition, has been realized. Consequently, a greater amount of energy is available to crank engine 12. System 10 also provides a way to charge a discharged battery 21 using energy stored by capacitor 14. System 10 thus reduces battery wear due to deep discharging and also provides a higher probability of a successful engine 12 start.

While this invention has been shown and described with respect to a detailed embodiment thereof, it will be understood by those skilled in the art that changes in form and detail thereof may be made without departing from the scope of the claims of the invention.

What is claimed is:

1. An engine starting assist system, comprising:

a battery;

an ultracapacitor;

a contactor configured to selectably couple together the battery and the ultracapacitor; and a controller configured to: monitor the condition of the battery; monitor the condition of the ultracapacitor; control the flow of energy between the battery and the ultracapacitor in a predetermined manner based upon the condition of the battery and the condition of the ultracapacitor, the flow of the energy being controlled by selective actuation of the contactor; receive a start input control signal; and issue a start output control signal, the energy stored in the ultracapacitor being selectably used to charge the battery and provide cranking current to a starter of an engine in conjunction with the battery, and the energy stored in the battery being selectably used to charge the ultracapacitor; provide cranking current to the starter in conjunction with the ultracapacitor; and act as a sole source of cranking current to the starter.

2. The engine starting assist system of claim 1, further comprising a pre-charge switch connected in parallel with the contactor.

3. The engine starting assist system of claim 2, wherein the pre-charge switch is duty-cycle controlled.

4. The engine starting assist system of claim 1, further including a pre-charge switch comprising a selectably activated DC-DC converter connected in parallel with the contactor.

5. The engine starting assist system of claim 2, wherein the pre-charge switch is configured to controllably charge the ultracapacitor using energy stored by the battery.

6. The engine starting assist system of claim 2, wherein one of the pre-charge switch and the contactor is configured to charge the battery using energy stored by the ultracapacitor.

7. The engine starting assist system of claim 1, further comprising a multiplexed vehicle control system configured to provide at least one of a controller activation control signal and an engine start control signal to the controller.

8. The engine starting assist system of claim 1, further comprising a dead battery switch configured to provide a controller activation signal to the controller.

9. The engine starting assist system of claim 8 wherein the controller activation control signal is a selectively applied logic voltage.

10. The engine starting assist system of claim 8 wherein the controller activation control signal is a selectively applied logic ground connection.

11. The engine starting assist system of claim 1, further comprising: a starter solenoid; and a start switch connected between the controller and the starter solenoid, the start switch being controlled by the controller to selectively actuate the starter solenoid, the starter solenoid operating a starter to start the engine.

12. The engine starting assist system of claim 1, wherein the controller is one of a computer, microcontroller, central processing unit, programmable controller, and logic device, microprocessor, and ladder logic device.

13. An engine starting assist system, comprising:

a battery;

an ultracapacitor;

a controller;

a starter solenoid;

a contactor configured to selectably couple together the battery and the ultracapacitor;

a pre-charge switch connected in parallel with the contactor, the pre-charge switch being selectably activated by the controller; and a start switch connected between the controller and the starter solenoid, the start switch being selectably activated by the controller;

the controller being configured to: monitor the condition of the battery; monitor the condition of the ultracapacitor; control the flow of energy between the battery and the ultracapacitor in a predetermined manner based upon the condition of the battery and the condition of the ultracapacitor, the flow of the energy being controlled by selective actuation of the contactor; receive a start input control signal; and issue a start output control signal, the energy stored in the ultracapacitor being selectably used to charge the battery and provide cranking current to a starter of an engine in conjunction with the battery, and the energy stored in the battery being selectably used to charge the ultracapacitor;

provide cranking current to the starter in conjunction with the ultracapacitor; and act as a sole source of cranking current to the starter.

14. The engine starting assist system of claim 13 wherein the pre-charge switch is duty-cycle controlled.

15. The engine starting assist system of claim 13 wherein the pre-charge switch is a selectably activated DC-DC converter.

16. The engine starting assist system of claim 13 wherein the pre-charge switch is configured to controllably charge the ultracapacitor using energy stored by the battery.

17. The engine starting assist system of claim 13 wherein one of the pre-charge switch and the contactor is configured to charge the battery using energy stored by the ultracapacitor.

18. The engine starting assist system of claim 13, further comprising a multiplexed vehicle control system configured to provide at least one of a controller activation control signal and an engine start control signal to the controller.

19. The engine starting assist system of claim 13, further comprising a dead battery switch configured to provide a controller activation signal to the controller.

20. A method for controlling the starting of an engine, comprising the steps of:

selectably connecting a battery to a starter of the engine;

providing an ultracapacitor;

charging at least one of the battery and the ultracapacitor; and providing a controller configured to: monitor the condition of the battery; monitor the condition of the ultracapacitor; control the flow of energy between the battery and the ultracapacitor in a predetermined manner based upon the condition of the battery and the condition of the ultracapacitor, the flow of the energy being controlled by selective actuation of the contactor; receive a start input control signal; and issue a start output control signal, the energy stored in the ultracapacitor being selectably used to charge the battery and provide cranking current to a starter of an engine in conjunction with the battery, and the energy stored in the battery being selectably used to charge the ultracapacitor; provide cranking current to the starter in conjunction with the ultracapacitor; and act as a sole source of cranking current to the starter.

* * * * *